US006729754B1

(12) United States Patent
Midas

(10) Patent No.: US 6,729,754 B1
(45) Date of Patent: May 4, 2004

(54) PAINT CONTAINER LIFTING ATTACHMENT FOR PAINT MIXERS

(75) Inventor: Thomas J. Midas, Oak Park Heights, MN (US)

(73) Assignee: Red Devil Equipment Corporation, Brooklyn Park, MN (US)

( * ) Notice: Subject to any disclaimer, the term of this patent is extended or adjusted under 35 U.S.C. 154(b) by 0 days.

(21) Appl. No.: 10/235,978

(22) Filed: Sep. 5, 2002

(51) Int. Cl.[7] ..... B01F 11/00; B01F 15/00
(52) U.S. Cl. ..... 366/208; 366/605
(58) Field of Search ..... 366/110–112, 114, 366/208–217, 605, 349

(56) References Cited

U.S. PATENT DOCUMENTS

| | | | | | |
|---|---|---|---|---|---|
| 5,116,134 | A | * | 5/1992 | Edwards et al. | 366/208 |
| 5,137,367 | A | * | 8/1992 | Madonia et al. | 366/218 |
| 5,383,163 | A | | 1/1995 | Brunn | 366/217 |
| 5,749,652 | A | | 5/1998 | Brunn et al. | 366/209 |
| 6,612,732 | B2 | * | 9/2003 | Blakeman, II et al. | 366/209 |

OTHER PUBLICATIONS http://www.industrialgassprings.com/Brochure/Page6.asp, "Industrial Gas Springs—Information Pages", downloaded Aug. 5, 2002. 4 pages.

Red Devil Equipment Co., brochure, "The 5305 Speed Demon 5 Series" dated prior to Sep. 5, 2002, 2 pages.

Red Devil Equipment Co., brochure, "Simple Design–Durable Products–Full–Line Provider" dated prior to Sep. 5, 2002, 16 pages.

* cited by examiner

*Primary Examiner*—Charles E. Cooley
(74) *Attorney, Agent, or Firm*—Faegre & Benson LLP

(57) ABSTRACT

A lifting attachment for lifting paint containers into and out of paint mixers of the type supported by a generally horizontal surface and including at least one side, the lifting attachment having a pair of rigidly connected arms, each including a proximal end pivotably connected to the paint mixer and a distal end extending beyond the side of a paint mixer, a mechanical link in the form of a strap and hook connected to a cross member intermediate the proximal and distal ends of the arms for lifting and lowering a paint bucket into and out of the paint mixer and a pair of gas springs connected between the paint mixer and the lifting arms for urging the lifting attachment vertically upwards.

21 Claims, 13 Drawing Sheets

PAINT CONTAINER LIFTING ATTACHMENT FOR PAINT MIXERS

BACKGROUND OF THE INVENTION

Powered mixers are popular in retail outlets selling paint. When the paint is vended in five gallon buckets (or similar containers), considerable effort required to lift the buckets into and out of the mixers. One fort of assistance has been to provide a roller conveyor in front of one version of a paint mixer to raise the bucket to a height at or near that necessary to slide the bucket into the mixer. However, with "drop-in" type paint mixers further lifting effort is still required to move the bucket between the conveyor and mixer. The present invention reduces this effort and provides an attachment that makes it easier to lift five gallon buckets or similar containers of paint into and out of "drop-in" type paint mixers. The present invention will accomplish its function whether or not a conveyor is present in front of the mixer.

BRIEF SUMMARY OF THE INVENTION

The present invention, in one aspect, includes a lifting attachment apparatus for lifting paint containers into and out of paint mixers, where the attachment apparatus is in combination with the paint mixer and includes a paint mixer supported by a generally horizontal surface with at least one side, at least one lifting arm including a proximal end pivotably connected to the paint mixer and a distal end extending beyond the side of a paint mixer, a mechanical link connected to the lifting arm intermediate the proximal and distal ends for lifting and lowering a paint container into and out of the paint mixer, and a spring means connected between the paint mixer and the lifting arm for urging the lifting arm vertically upwards.

The present invention, in another aspect, includes a method of assisting movement of a paint container into and out of a paint mixer according to the steps of providing a lifting attachment having at least one lifting arm with a proximal end pivotably connected to a paint mixer and a distal end extending beyond a side of a paint mixer, a mechanical link connected to the lifting arm intermediate the proximal and distal ends for lifting and lowering a paint container into and out of the paint mixer, and spring means connected between the paint mixer and the lifting arm for urging the lifting arm vertically upwards, engaging the mechanical link to the paint container; and assisting movement of the paint container with respect to the mixer by moving the lifting arm with the assistance of the spring means.

DETAILED DESCRIPTION

Figure 1:
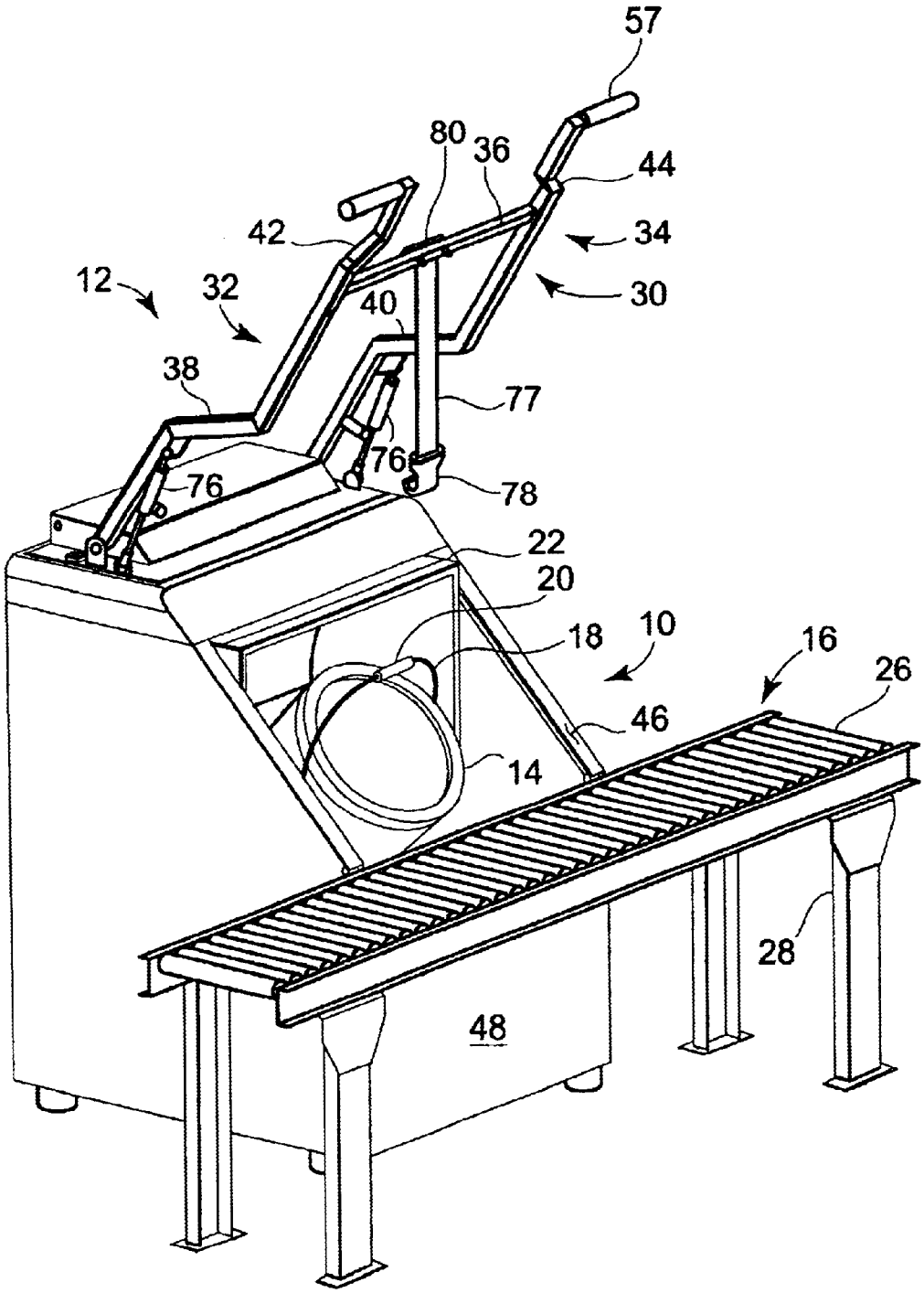
FIG. 1 is a perspective view from the front and above of a conveyor and paint mixer with the lifting attachment of the present invention shown with a paint bucket in the mixer.
Figure 2:
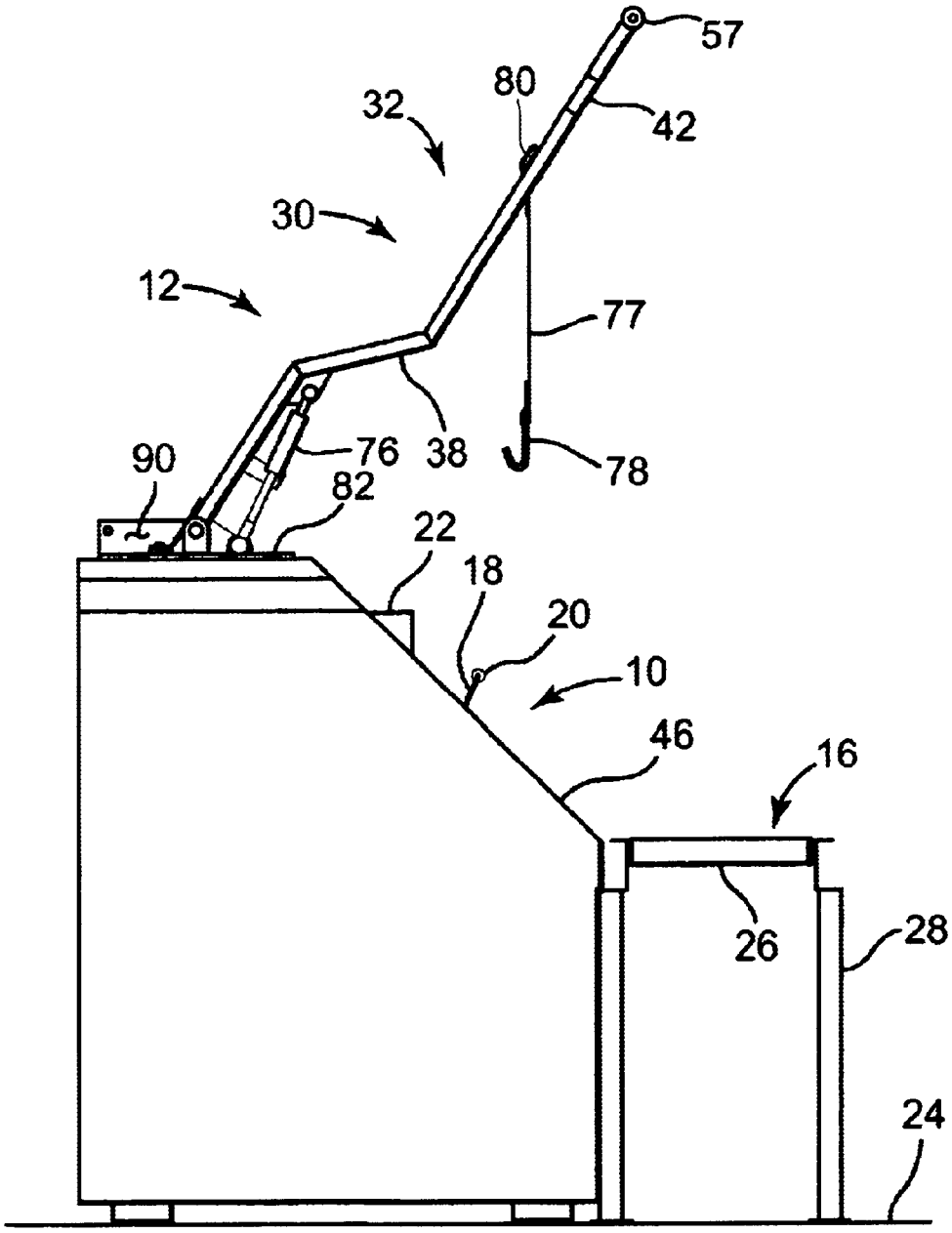
FIG. 2 is a side elevation view of the mixer and attachment of FIG. 1.

Referring now to the Figures, and most particularly to FIG. 1, a paint mixer 10, together with a lifting attachment 12 useful in the practice of the present invention, may be seen. Paint mixer 10 is preferably a Model 5305, available from Red Devil Equipment Co., 7150 Boone Avenue North, Suite 100, Brooklyn Park, Minn. 55428. In the past, it was necessary to manually lift a five gallon paint container or bucket 14 into and out of the mixer. The lifting attachment 12 of the present invention reduces the effort required to move the paint container 14 into and out of the mixer 10. Typically, a conveyor 16 is located in front of the mixer and preferably extends from a colorant dispenser or tinting station (not shown) to the mixer 10 to assist in moving the five gallon buckets 14 of paint from the tinting station to a mixing station at the mixer. It is to be understood that additional conveyor segments are typically present to extend the length of the conveyor 16 as desired. It is also to be understood that bucket 14 has a bail 18 and handle 20. A door or hood 22 is pivotably attached to mixer 10 and is closed prior to operating mixer 10. As may be seen most clearly in FIG. 2, both the mixer 10 and conveyor 16 are preferably supported on a floor or other horizontal surface 24. Conveyor 16 preferably is a non-powered conveyor having a plurality of rollers 26 supported by a frame 28, and may include multiple sections similar or identical to the section shown in the figures to transport paint containers 14 towards and away from mixer 10, as desired.

Referring now also to FIGS. 2*a*, 2*b*, 2*c*, and 2*d*, the lifting attachment 12 preferably includes an arm weldment 30 having a pair of arms 32, 34, and a cross brace 36 welded in an "H" form with two pairs of diagonal offsets 38, 40 and 42, 44. The first pair of diagonal offsets 38, 40 are arranged in arms 32, 34, respectively to conform to a sloping portion 46 of a front side 48 of mixer 10. As used herein, "side" is to be understood to include the front surface of the mixer 10, encompassing one or both of the sloping portion 46 and the vertically oriented parts of side 48. The second pair of diagonal offsets 42, 44 reduce the width between a pair of manually graspable handles 50, 52. Each of arms 32 and 34 are preferably formed of ⅛×1.0×1.0 inch cold rolled hollow steel tubing having a square cross section. The cross brace 36 is preferably formed of 16 gauge 0.50×1.00 inch cold rolled hollow steel tubing. The handles 50, 52 are preferably formed of ⅞ OD cylindrical steel tubing extend from proximal ends of arms 32 and 34, respectively, and each has a conventional vinyl handle grip 57 received thereon. A pair of circular cross section pieces of ⅞ OD steel tubing form a pair of journals 58, 60 at distal ends of the arms 32, 34, respectively, to allow the arm weldment 30 to pivot with respect to its mounting, to be described infra. A pair of cross section pieces of ⅞ OD steel tubing form projections 62, 64 to carry bumpers 65 which limit downward travel of the lifting attachment 12 after installation. A pair of 1 inch wide, 6 gauge steel angle flanges 66 each have an ear 70 formed at an angle of 122 degrees to carry a bumper 69 to limit upward travel of the lifting attachment 12. Bumpers 65 and 69 are conventional, with bumpers 65 preferably having a shore durometer of 40 and bumpers 69 preferably having a shore durometer of 70. A pair of 1 inch wide, 6 gauge steel gussets 72 each have an aperture 74 therein to receive an end of a gas spring 76 to provide lifting support for lifting attachment 12. Gas springs 76 are preferably rated at 80 lbs. and preferably have an operating range of 7.09 to 9.09 inches, with metal ball ends, each having a conventional threaded stud for attachment to the lifting attachment 12 using conventional washers and nuts.

A 2 inch wide strap of nylon webbing 77 carries a hook 78 sized and shaped to receive bail handle 20 on bucket 14. The hook 78 is preferably formed of 7 gauge steel. As may be seen most clearly in FIG. 2*c*, webbing 77 preferably has a pair of loops 79 formed at each end of the strap by stitching the webbing to itself. One loop captures the hook 78, and the other loop is received over a plate clamp 80. The hook and webbing subassembly is preferably sized to enable the hook to release from the handle 20 when the lifting attachment is at or near the lowermost position. The hook and webbing subassembly is preferably secured to the cross brace 36 by the plate clamp 80. As may be seen most clearly in FIGS. 2*c* and 2*d*, conventional nuts are preferably used to secure bumpers 69 and plate clamp 80 to the lifting attachment 12.

Figure 2A:
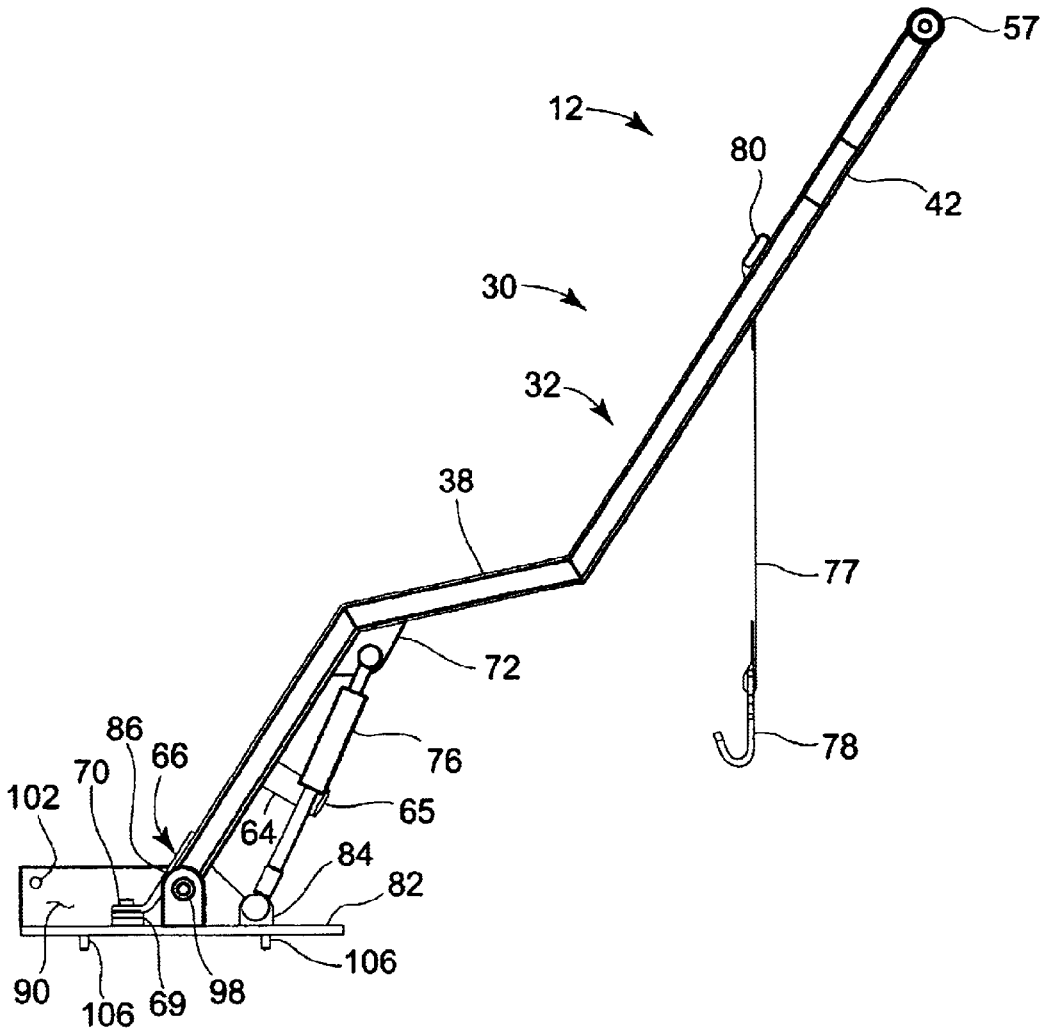
FIG. 2*a* is an enlarged view of a portion of FIG. 2 showing the lifting attachment assembly.
Figure 2B:
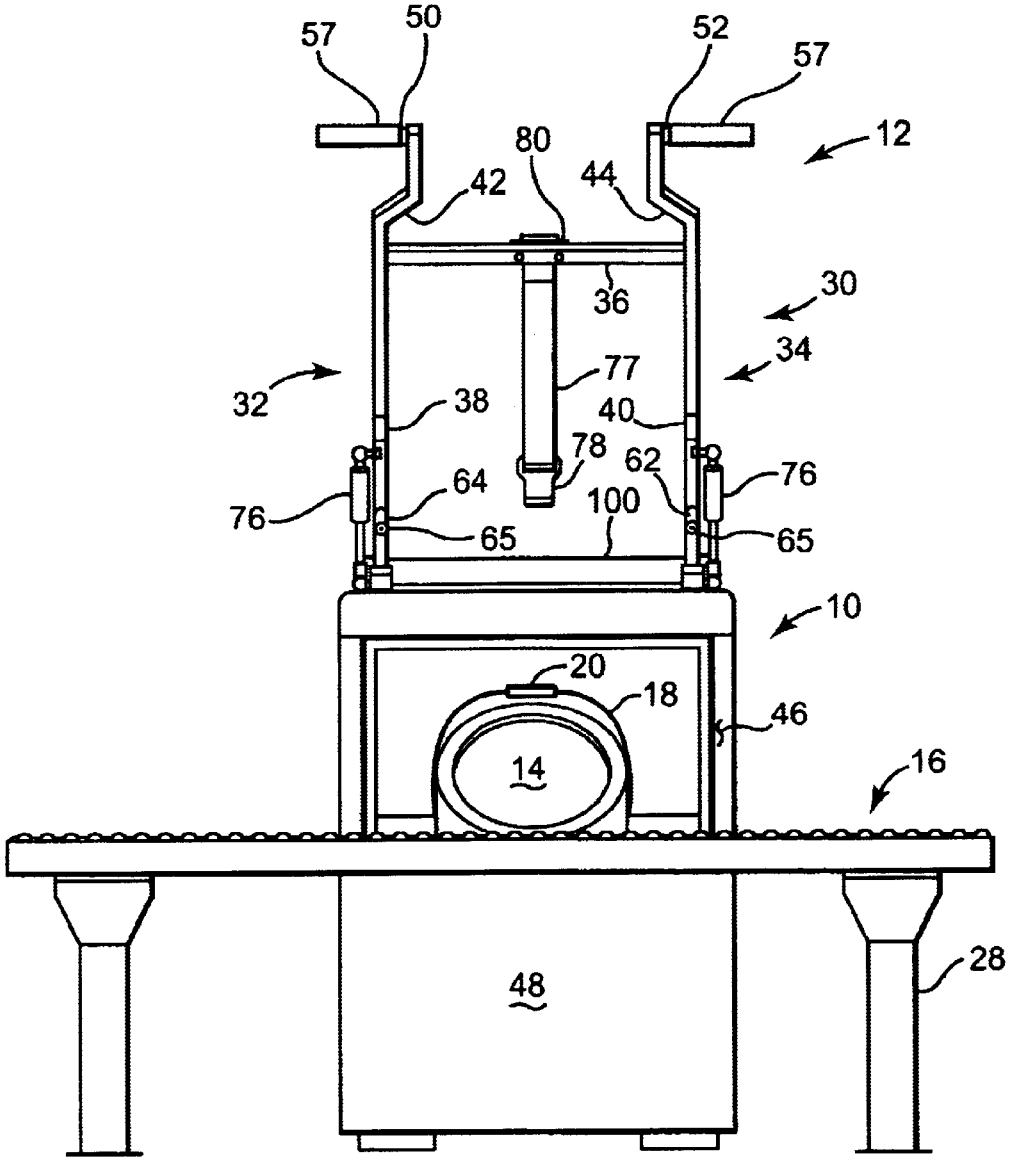
FIG. 2*b* is a front elevation view of the mixer and attachment of FIG. 1.
Figure 2C:
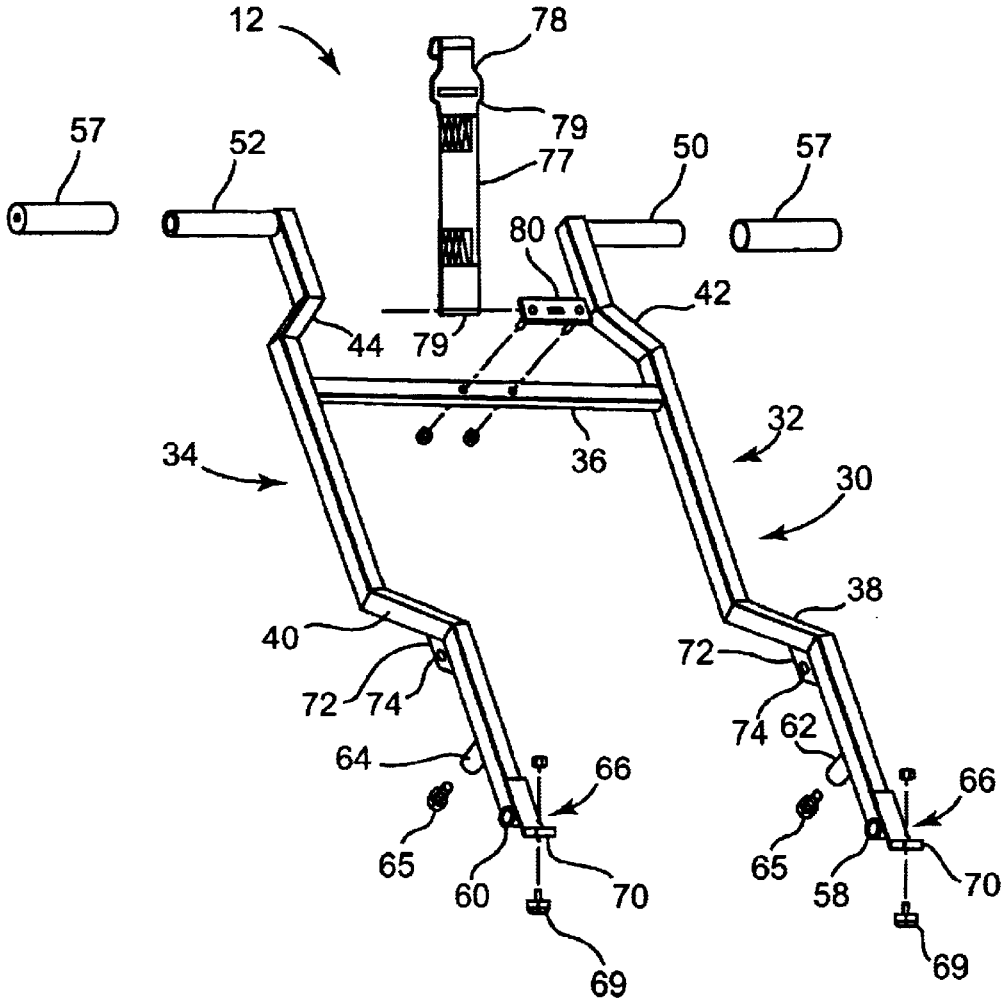
FIG. 2*c* is an exploded view of a weldment subassembly with associated parts useful in the practice of the present invention.
Figure 2D:
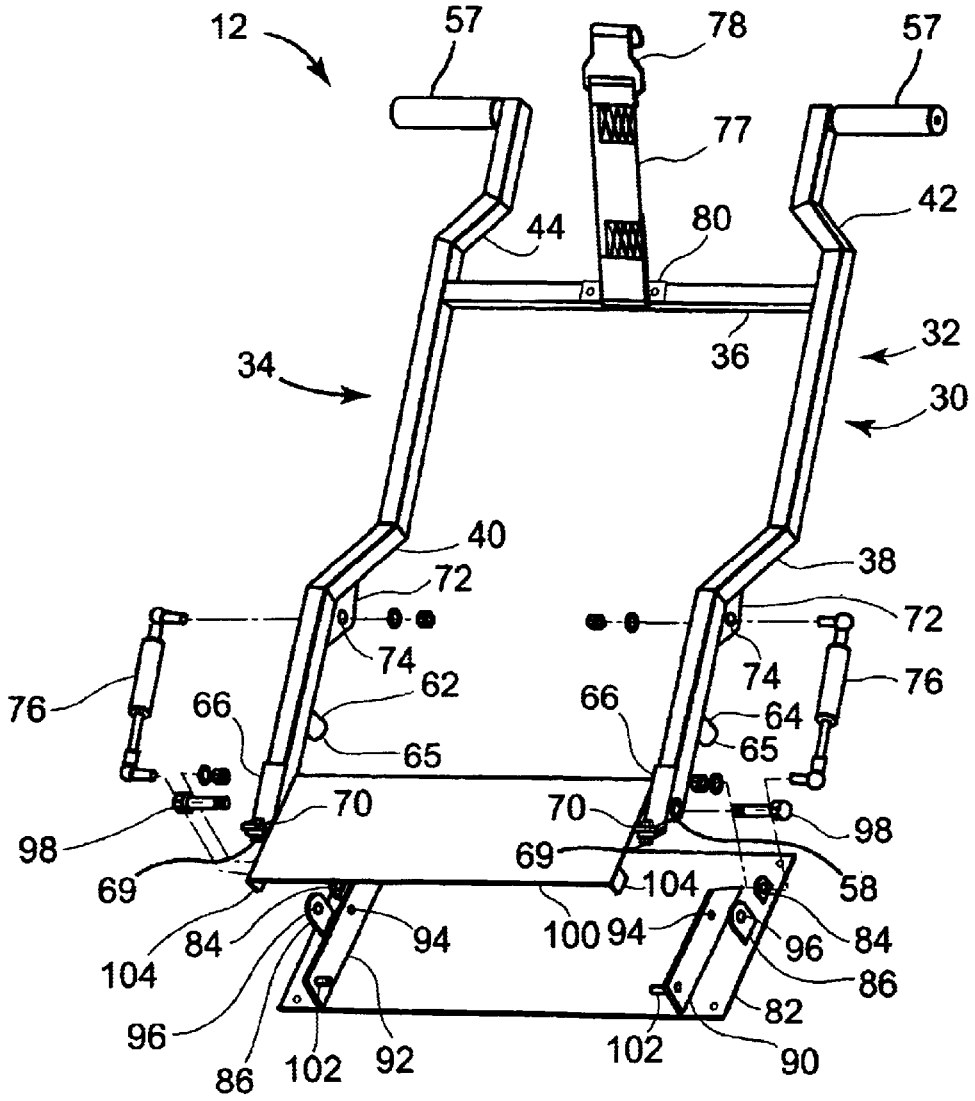
FIG. 2*d* is an exploded view of the lifting attachment assembly.

Referring now most particularly to FIGS. 2*a* and 2*d*, a plate 82 has a first pair of tabs 84 welded thereto for securing the gas springs 76, and further has a second pair of tabs 86 welded to the plate 82 to support the arms 32, 34 at the journals 58, 60. A pair of end walls 90, 92 are similarly welded to plate 82. Each of the tabs 84, 86 and end walls 90, 92 are to be understood to include conventional projections received in notches (not shown) in plate 82 for maintaining the respective locations of these parts as they are welded together. End walls 90, 92 each have an aperture 94 aligned with an aperture 96 in tabs 86 to receive a conventional shoulder bolt 98 to form a pivot in each of journals 58, 60. A decorative sheet metal cover 100 is preferably received over plate 82 and attached to end walls 90, 92 via studs 102 received in slotted tabs 104 welded to cover 100. A conventional nut (not shown) is received over each of studs 102 and tightened to secure cover 100 to the lifting attachment assembly 12.

Refining now again most particularly to FIG. 2*a*, a plurality of studs 106 preferably project downward from plate 82 and are used to secure the lifting attachment assembly 12 to the mixer 10 in a conventional manner.

Figure 3:
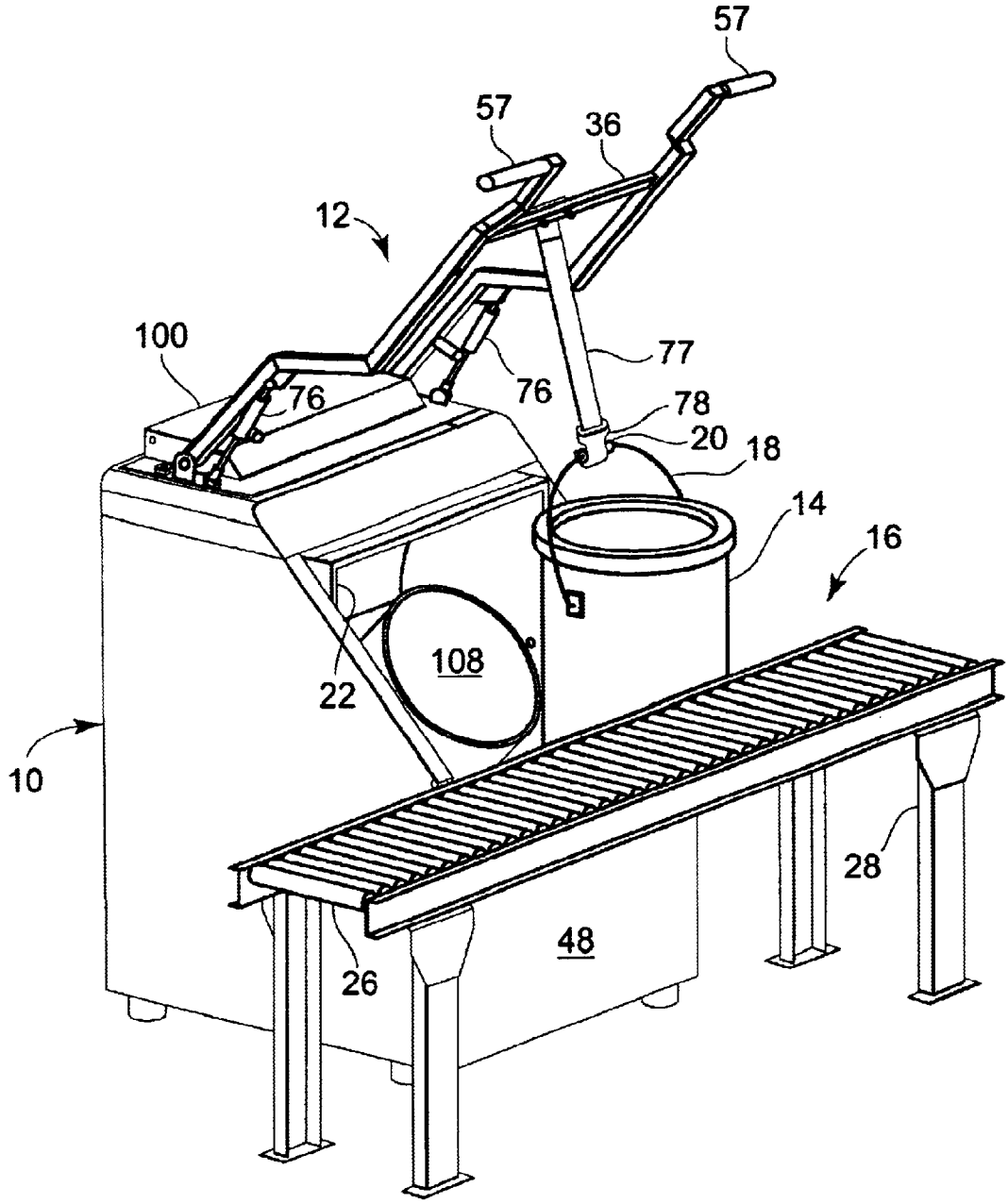
FIG. 3 is a view similar to FIG. 1, except with the paint bucket on the conveyor and the lifting attachment connected to the bucket in a first position.
Figure 4:
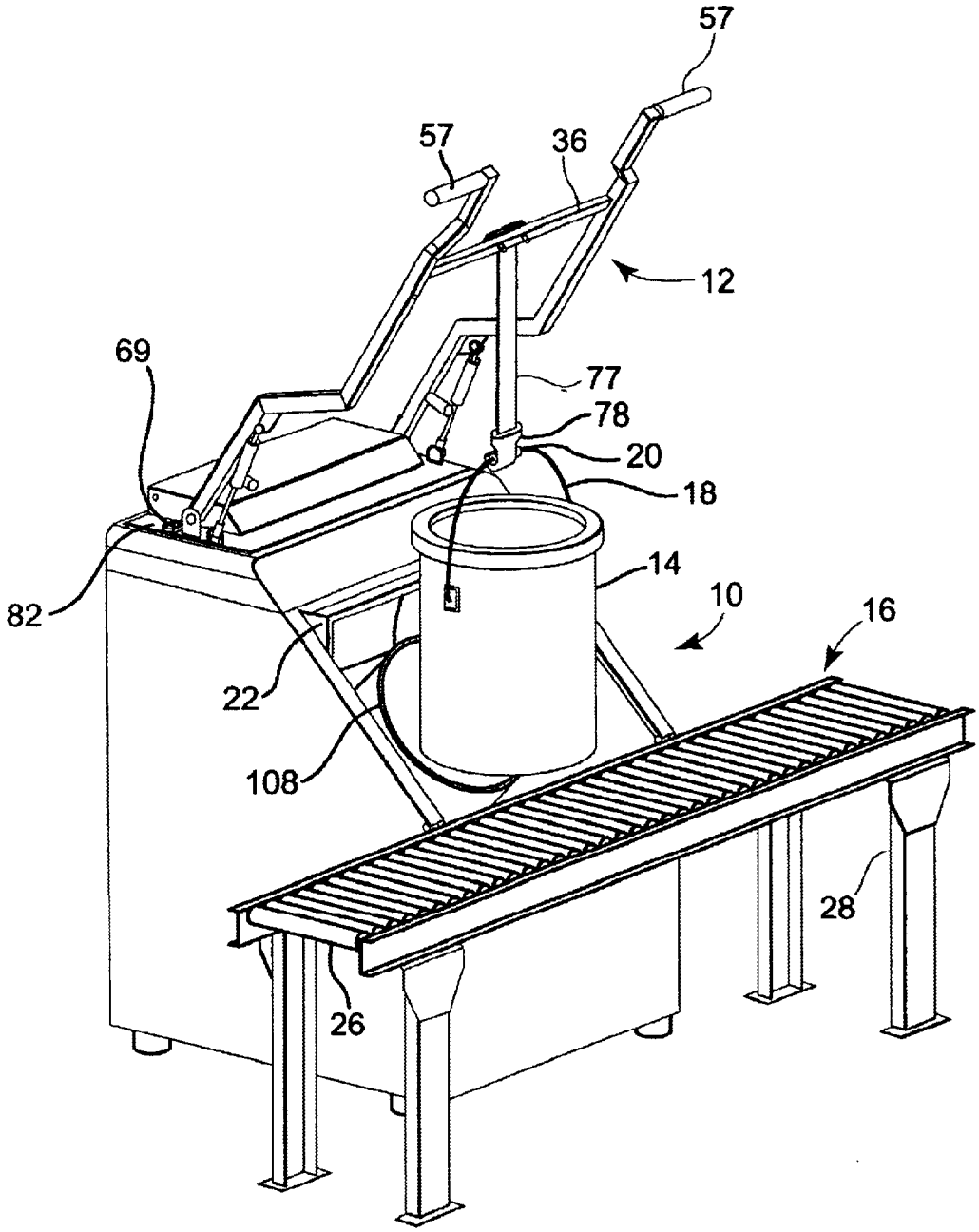
FIG. 4 is a view similar to that of FIG. 3, except with the lifting attachment raised to lift the bucket to a second position.

Referring now to FIGS. 3, 4, 5 and 6, the operation of the lifting attachment will be explained. In FIG. 3, a paint bucket 14 is shown located on the conveyor 16 just prior to insertion into the mixer 10. At this position, the arms 32, 34 of the lifting attachment 12 have been manually lowered and the hook 78 has been manually engaged with the bail handle 20 of the bucket 14. In FIG. 4, the lifting attachment has been manually elevated with the aid of the gas springs 76, by grasping at least one handle grip 57 and raising assembly 12 until the bucket clears a bucket receptacle 108 in the mixer 10. It is to be understood that cross brace 36 will move laterally, as well as vertically, as the assembly 12 is elevated, moving bucket 14 closer to receptacle 108 as the assembly is elevated.

Figure 5:
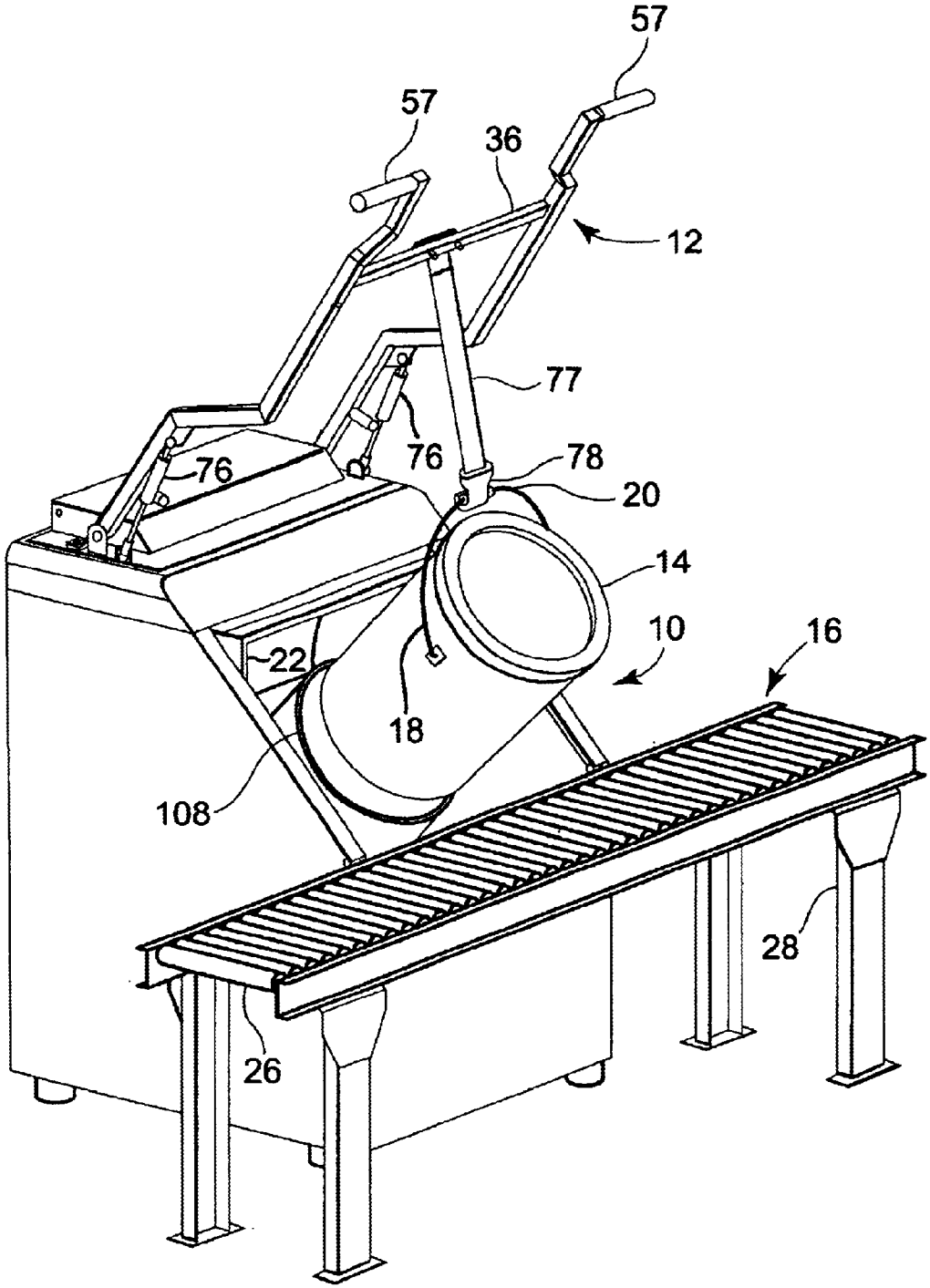
FIG. 5 is a view similar to that of FIG. 4, except with the bucket moved laterally and rotated to a position in which the bucket is about to be received in the mixer while still supported by the lifting attachment.
Figure 6:
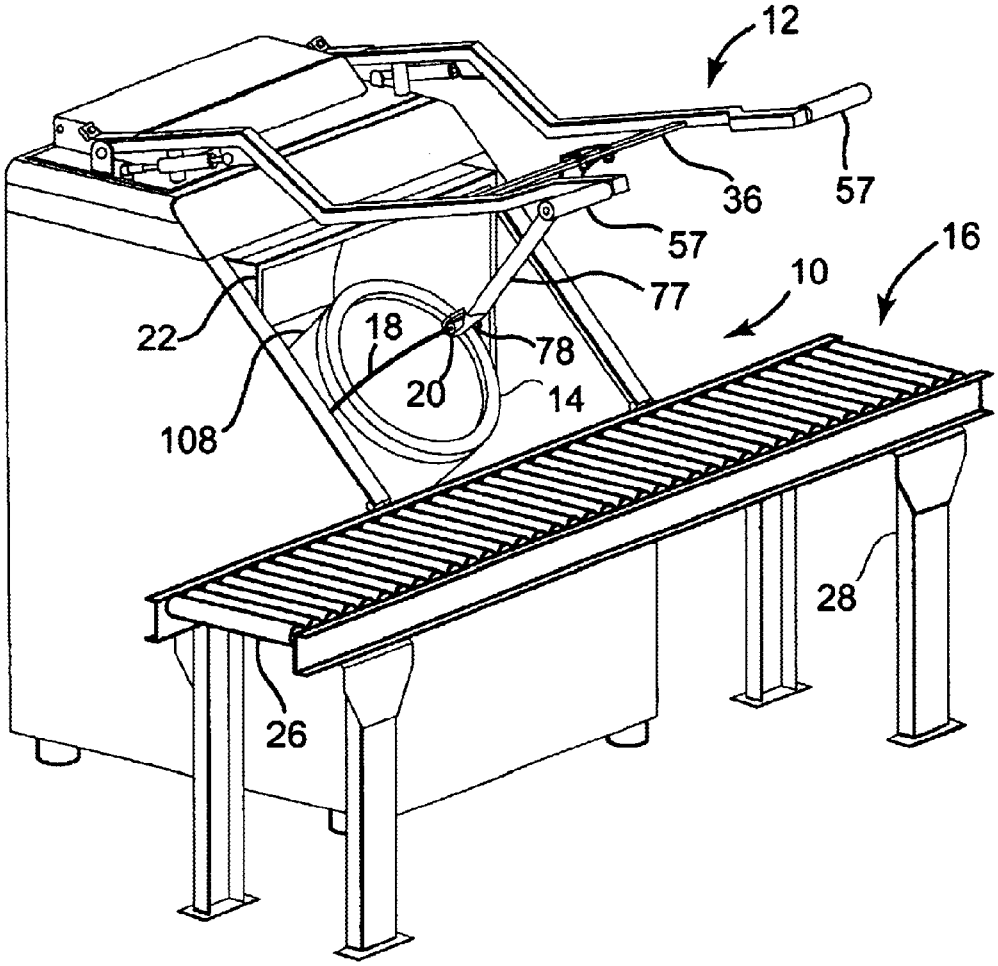
FIG. 6 is a view similar to that of FIG. 5, except with the bucket fully received in the mixer and with the lifting attachment lowered to a position just prior to release from the bucket.

In FIG. 4, the assembly 12 is nearly fully elevated, evidenced by close approach of bumpers 69 to plate 82. At this time, the bucket 14 is positioned over the receptacle 108, but is not aligned therewith. In FIG. 5, the bucket 14 is manually aligned with receptacle 108, while attachment 12 is held in the fully elevated position. The lifting attachment is then lowered to the position shown in FIG. 6, using one or both handle grips 57, while the bucket 14 slides into receptacle 108, coming to rest as shown in FIG. 6. The lifting attachment 12 is shown in FIG. 6 positioned slightly above its lowermost position. This allows arms 32, 34 to be lowered to the lowermost position (not shown) at which time the bail handle 20 is released from hook 78. The lifting attachment is then released from manual control, at which time it will return to the uppermost position similar to that shown in FIGS. 4 and 5, but with the bucket 14 remaining fully received in receptacle 108. It is to be understood that the uppermost position will allow the lifting attachment to move (preferably about four inches in travel) higher than that shown in FIGS. 4 and 5, to enable the lifting attachment to rest in a position providing greater clearance to the mixer 10 than that shown in FIGS. 4 and 5. After the lifting attachment is elevated and released, door 22 is closed on mixer 10 and the paint is agitated by mixer 10, after which the door 22 is opened and the process described above is repeated in reverse order to lift the bucket 14 from the mixer and return it to the conveyor 16.

Figure 7:
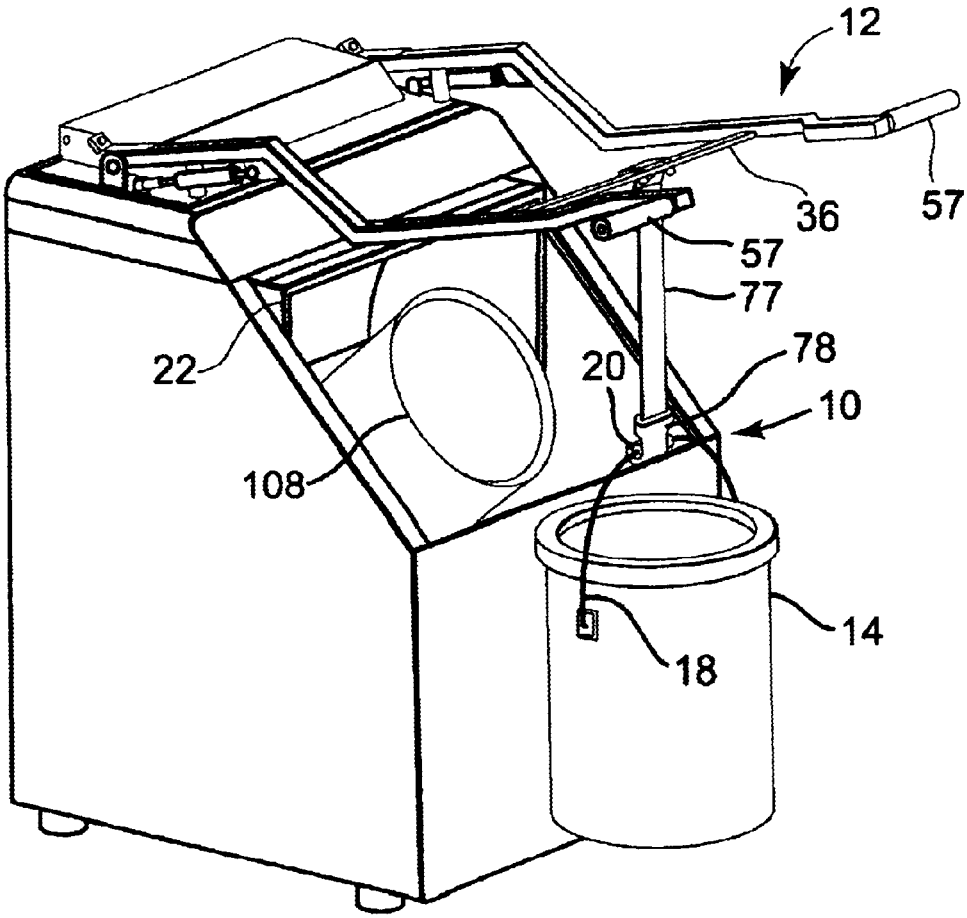
FIG. 7 is a view similar to FIG. 3 except without a conveyor and with the bucket elevated slightly above the surface supporting the paint mixer.

In an alternative arrangement as shown in FIG. 7, a paint bucket 14 may be located on the floor 24 in front of mixer 10, where the lifting attachment 12 may be used to assist raising the bucket 14 from the floor and into and out of the mixer 10. The conveyor 16 is absent from this arrangement.

Figure 8:
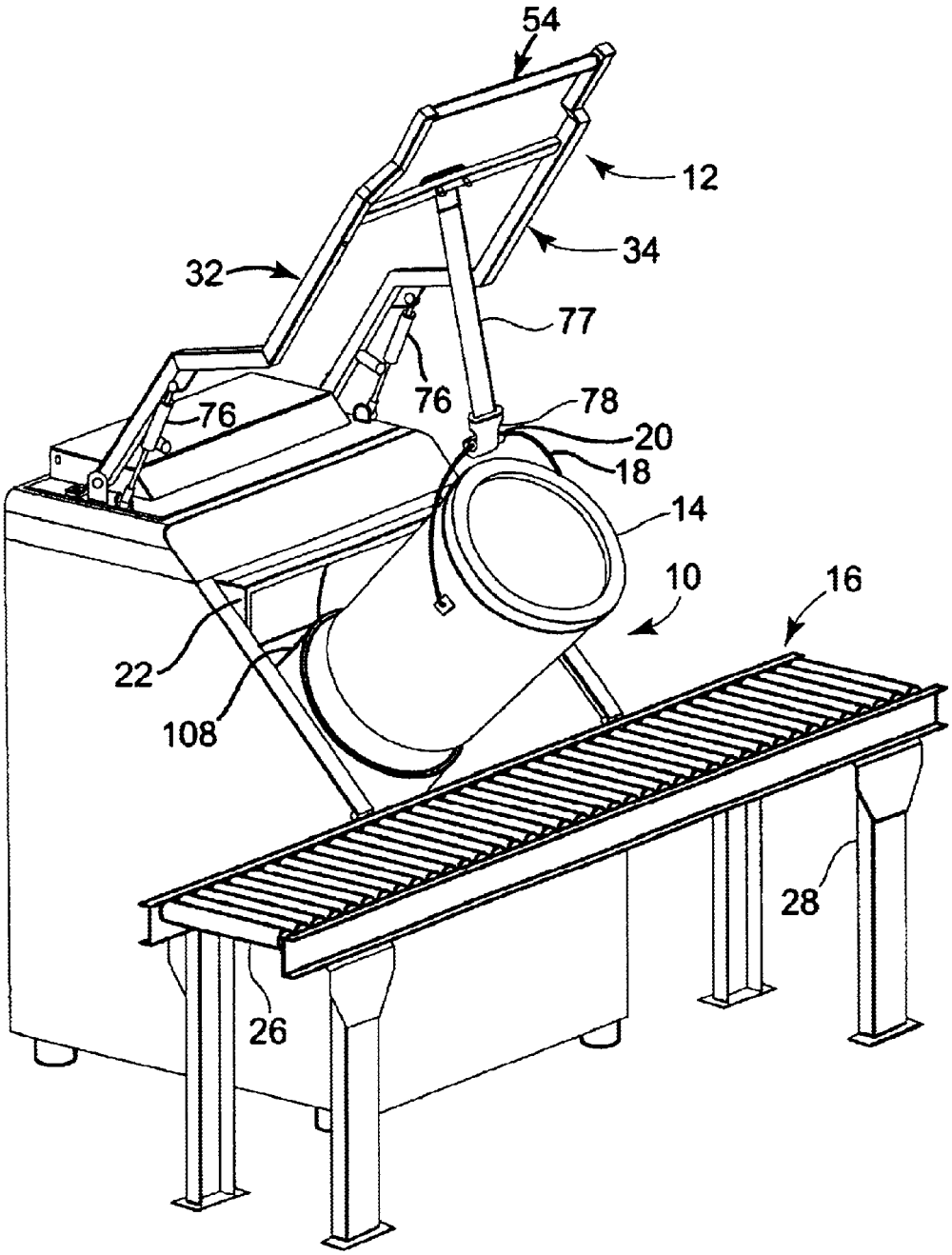
FIG. 8 is a view similar to that of FIG. 5, except with a single handle.

Referring now most particularly to FIG. 8, an alternative embodiment of the present invention may be seen. In this embodiment, a single elongated handle 54 extends between the arms 32 and 34. Handle 54 may have a vinyl grip thereon, similar to grip 57 for handles 50 and 52.

Figure 9:
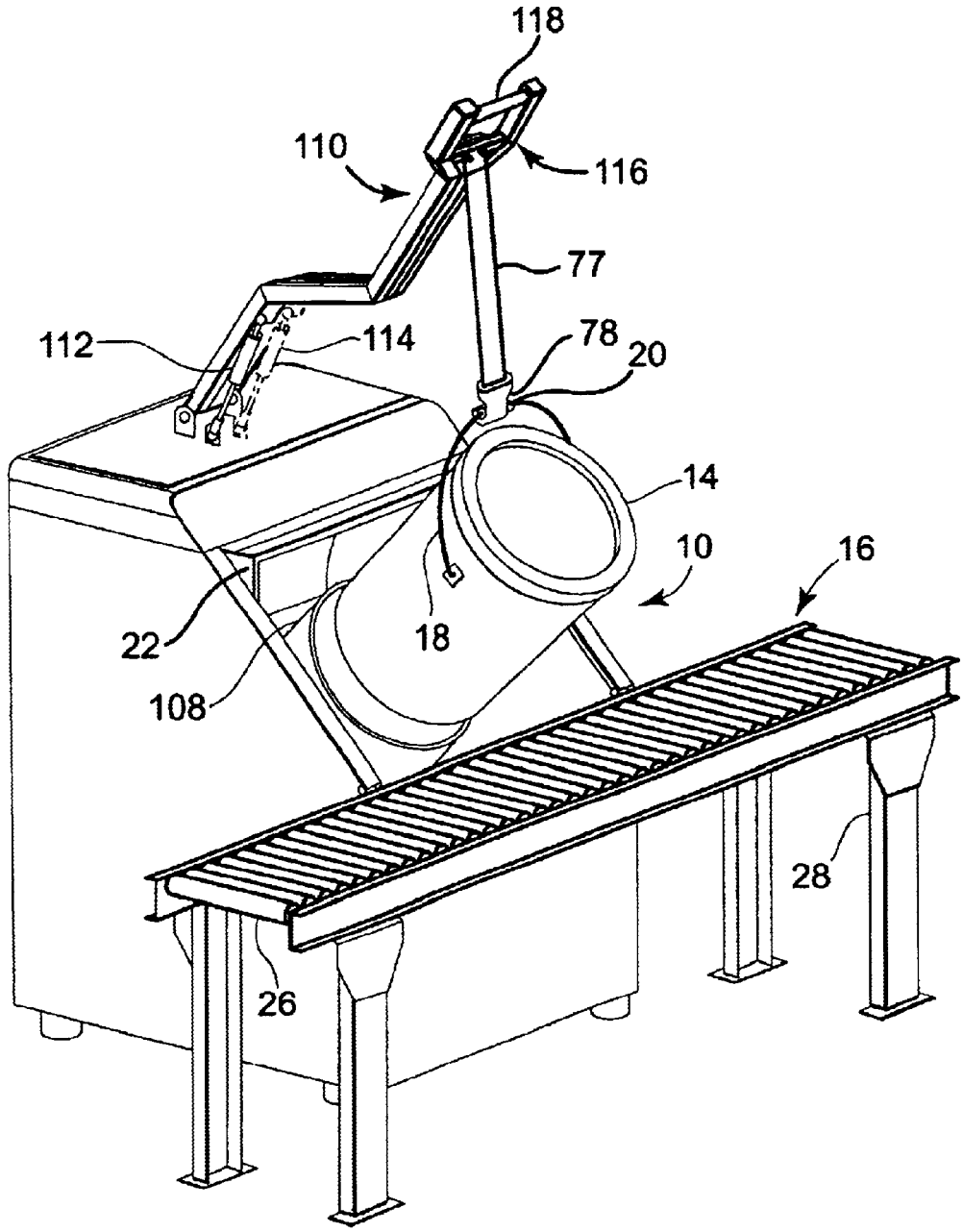
FIG. 9 is an alternative embodiment showing a single arm version of the lifting attachment useful in the practice of the present invention.
Figure 3:
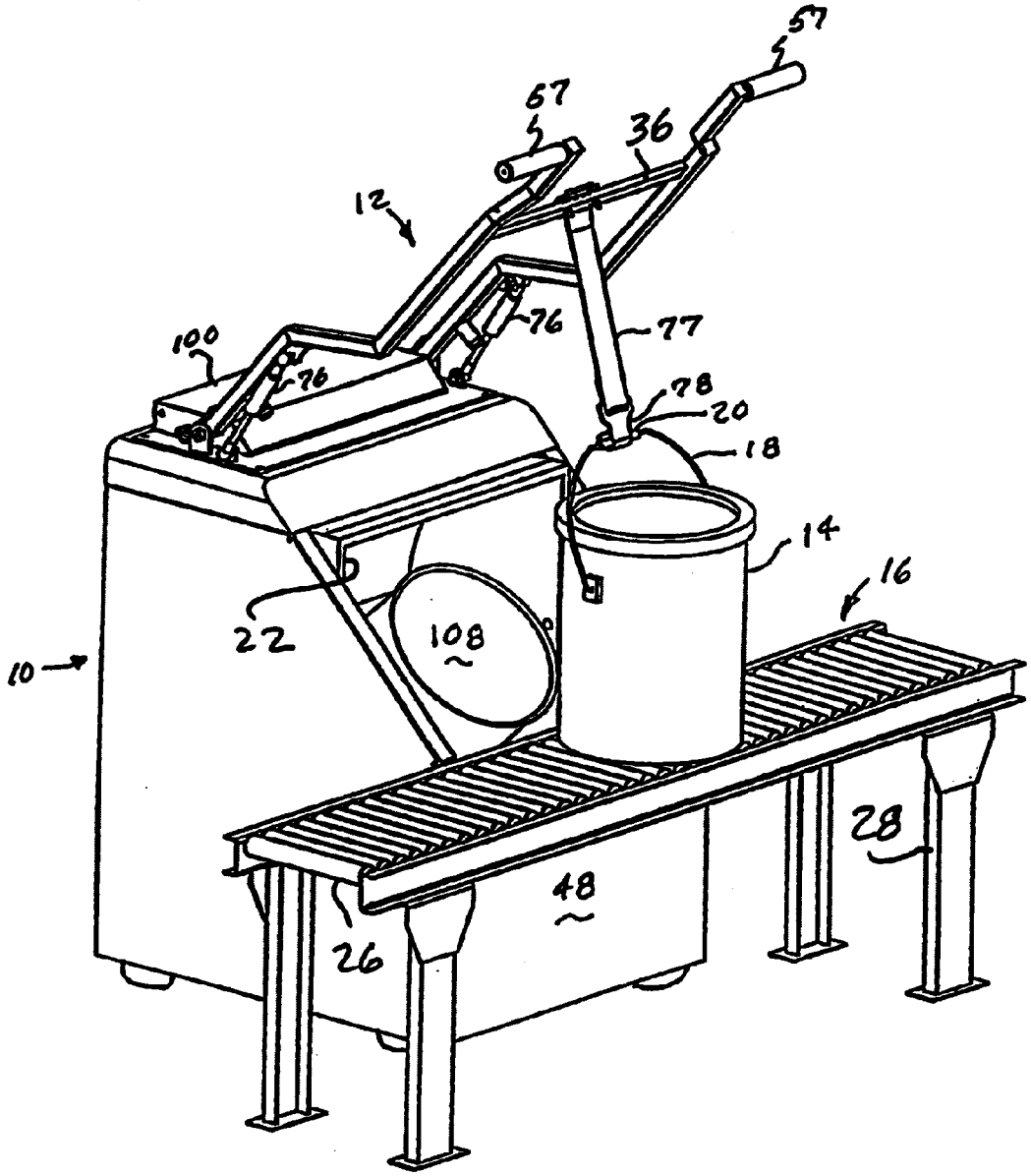

Referring now to FIG. 9, a still further alternative embodiment of the present invention utilizes a single arm 110 replacing and performing the functions of arms 32 and 34. Arm 110 may be made of stronger material, if desired, or may be made of larger cross section material, to adequately support the increased loading for a single arm embodiment. An increased capacity spring 112, preferably doubling the force of spring 76, (but with the same stroke) may be used in this embodiment. Alternatively a pair of springs 112, 114 may be used with ratings the same as springs 76. In this embodiment, a yoke or Y-shaped member 116 may be used to support webbing 77, and a single handle 118 is preferable, with a vinyl grip, if desired.

This invention is not to be taken as limited to all of the details thereof as modifications and variations thereof may be made without departing from the spirit or scope of the invention.

What is claimed is:

1. A lifting attachment apparatus for lifting paint containers into and out of paint mixers, the attachment apparatus in combination with the paint mixer comprising a. a paint mixer supported by a generally horizontal surface and including at least one side;

b. at least one lifting arm including a proximal end pivotably connected to the paint mixer and a distal end extending beyond the side of a paint mixer;

c. a mechanical link connected to the at least one lifting arm intermediate the proximal and distal ends for lifting and lowering a paint container into and out of the paint mixer; and d. spring means connected between the paint mixer and the at least one lifting arm for urging the at least one lifting arm vertically upwards.

2. The apparatus of claim 1 wherein the lifting attachment apparatus comprises a pair of arms, each rigidly connected to the other, and the pair pivotably connected to the paint mixer.

3. The apparatus of claim 2 wherein the spring means includes a pair of spring means, with one spring means associated with each of the pair of arms.

4. The apparatus of claim 1 wherein the spring means is a gas spring.

5. The apparatus of claim 1 wherein the mechanical link comprises a strap.

6. The apparatus of claim 5 wherein the mechanical link further comprises a hook.

7. The apparatus of claim 1 wherein the container is supported on the same horizontal surface as the paint mixer prior to being lifted.

8. The apparatus of claim 1 wherein the container is supported on a conveyor above the horizontal surface and adjacent the paint mixer prior to being lifted.

9. The apparatus of claim 1 wherein the side of the mixer further comprises a front surface of the mixer.

10. The apparatus of claim 1 wherein the lifting attachment apparatus comprises an assembly having a pair of arms rigidly connected together with a cross member and wherein the mechanical link includes a strap connected at a proximal end to the cross member, and wherein the mechanical link further includes a hook at a distal end.

11. The apparatus of claim 10 wherein the lifting attachment apparatus is movable between a lower first position and an elevated second position and wherein the cross member is horizontally spaced away from the side of the paint mixer when the lifting attachment apparatus is in the first position.

12. The apparatus of claim 11 wherein the first position is generally horizontal.

13. The apparatus of claim 1 wherein the lifting attachment apparatus comprises an assembly having a single arm and wherein the mechanical link includes a strap connected at a proximal end to the single arm.

14. The apparatus of claim 1 wherein the paint container is a paint bucket.

15. The apparatus of claim 1 wherein the paint container is a five gallon container.

16. The apparatus of claim 15 wherein the paint container is a bucket.

17. A method of assisting movement of a paint container into and out of a paint mixer comprising the steps of:

a. providing a lifting attachment having at least one lifting arm with a proximal end pivotably connected to a paint mixer and a distal end extending beyond a side of the paint mixer, and a mechanical link connected to the at least one lifting arm intermediate the proximal and distal ends for lifting and lowering a paint container into and out of the paint mixer; and spring means connected paint mixer and the at least one lifting arm for urging the at least one lifting arm vertically upwards;

b. engaging the mechanical link to the paint container; and c. assisting movement of the paint container with respect to the mixer by moving the at least one lifting arm with the assistance of the spring means.

18. The method of claim 17 wherein the mechanical link comprises a strap and hook.

19. The method of claim 17 wherein the spring means comprises a gas spring.

20. The method of claim 17 wherein the lifting attachment further comprises at least one manually graspable handle connected to the at least one lifting arm.

21. The method of claim 17 wherein step c further comprises partially supporting the paint container with the lifting attachment during movement of the paint container with respect to the mixer.

* * * * *

UNITED STATES PATENT AND TRADEMARK OFFICE

CERTIFICATE OF CORRECTION

PATENT NO. : 6,729,754 B1
DATED : May 4, 2004
INVENTOR(S) : Thomas J. Midas

It is certified that error appears in the above-identified patent and that said Letters Patent is hereby corrected as shown below:

Title page,
Item [73], Assignee, should read as follows:
-- Red Devil Equipment Company --

Signed and Sealed this

Second Day of November, 2004

JON W. DUDAS
*Director of the United States Patent and Trademark Office*

UNITED STATES PATENT AND TRADEMARK OFFICE

CERTIFICATE OF CORRECTION

PATENT NO. : 6,729,754 B1
DATED : May 4, 2004
INVENTOR(S) : Midas

It is certified that error appears in the above-identified patent and that said Letters Patent is hereby corrected as shown below:

Delete Drawing Sheet 7 and substitute the drawing sheet consisting of FIG 3 as shown on the attached page.

Signed and Sealed this

Twenty-third Day of May, 2006

JON W. DUDAS
*Director of the United States Patent and Trademark Office*